United States Patent [19]

Wenz

[11] 4,262,615

[45] Apr. 21, 1981

[54] COVER CONSTRUCTION FOR A SEWING MACHINE WORK SUPPORT COLUMN

[75] Inventor: Herbert Wenz, Kaiserslautern, Fed. Rep. of Germany

[73] Assignee: Pfaff Industriemaschinen GmbH, Fed. Rep. of Germany

[21] Appl. No.: 144,014

[22] Filed: Apr. 28, 1980

[30] Foreign Application Priority Data

May 3, 1979 [DE] Fed. Rep. of Germany ... 7912750[U]

[51] Int. Cl.[3] ..... D05B 75/00

[52] U.S. Cl. ..... 112/260

[58] Field of Search ..... 112/259, 258, 260

[56] References Cited

U.S. PATENT DOCUMENTS

| | | | |
|---|---|---|---|
| 1,744,774 | 1/1930 | Le Vesconte | 112/260 |
| 2,367,813 | 1/1945 | Wesson | 112/260 |
| 2,945,461 | 7/1960 | Perla | 112/260 |
| 3,066,627 | 12/1962 | Schlosser et al. | 112/260 |
| 3,344,762 | 10/1967 | Szostak et al. | 112/260 |

*Primary Examiner*—H. Hampton Hunter

*Attorney, Agent, or Firm*—McGlew and Tuttle

[57] ABSTRACT

A cover construction for a sewing machine work support column which is adapted to contain a looper and a thread-cutting device comprises an upright support member or column upon which a substantially L-shaped cover member is pivotal. The cover member includes a cover plate portion which extends horizontally in a closed position and covers the top of the device and a side portion which extends vertically in a closed position. The cover plate member is openable to a position opened outwardly from the support member in which position the cover is located in a vertical position and the side portion in a horizontal position. The side portion includes two bearing faces which are defined on the back and the bottom faces thereof, respectively, and which will abut against a top bearing surface of a locking member which is displaceable along the height of the upright support member. In the open position, one bearing face on the side wall is engaged on the locking member and in the closed position, the bottom bearing face engages on the top of the locking member. The locking member is biased by a coil spring around the mounting member in an upward direction in which it contracts the bearing face on the side wall in an open position of the cover and the bearing face on the bottom wall in the closed position of the cover. In addition, the cover has a torsion spring associated with it which rotates it to an open position when the locking member is pushed downwardly against its biasing spring.

4 Claims, 3 Drawing Figures

1
2
3
4
5
6
7
8
9
10
11
12
13
14
15
16
17
18
19
20
21
22
23
24
25
26
27
28
29
30
A
III

COVER CONSTRUCTION FOR A SEWING MACHINE WORK SUPPORT COLUMN

BACKGROUND OF THE INVENTION

1. Field of the Invention

This invention relates, in general, to sewing machines and, in particular, to a new and useful sewing machine having a work support column with a cover construction for the column which may be opened and closed in a simple manner.

In known sewing machines with a work support column, the looper arranged at the upper end of the support column is covered by means of a flap pivotable about a horizontal axis. The cover flap is retained in the closing position by a ratchet mechanism provided with a leaf spring. To expose the looper, the operator grips the two opposite faces of the cover flap and pivots the flap about its axis into the open position, for which the holding force of the ratchet mechanism must be overcome at the beginning. As the cover flap is adapted to the form of the support column and is therefore greatly rounded, it is hard to take hold of it, even if fluted or roughened grip areas are provided. It may happen, therefore, that if the leaf spring is greatly tensioned, the operator's hand will slip off the cover flap or that a disproportionately high force must be applied to overcome the holding force of the ratchet mechanism.

2. SUMMARY OF THE INVENTION

The invention provides a sewing machine in which the cover flap can be pivoted into the open position in a simple manner and with little force.

The cover flap is designed so that, in the closing position thereof, one of the two bearing faces lying in the area of the axis and extending substantially at right angles to each other is turned toward the locking and actuating member. The locking and actuating member comprises an abutment face extending crosswise to the force direction of the spring, which face is thus directed substantially parallel to the corresponding bearing face of the cover flap. Due to this design or correlation of the cover flap and of the locking and actuating member, the spring associated with the locking and actuating member holds the cover flap counter to the action of the comparatively weaker spiral spring in the closing position. To expose the looper in the support column the locking and actuating member, expediently provided with a handle, is shifted counter to the force of the spring associated with it from the locking position into a release position, whereupon the spiral spring pivots the cover flap into the open position. The displacement of the locking and actuating member can be carried out by the operator by the movement of a finger alone, which is much simpler and easier than the gripping of the hard-to-grip cover flap and the manual overcoming of the holding force of a ratchet mechanism.

According to a further aspect of the innovation, the locking and actuating member touches, when the cover flap is in closing position, the bearing face thereof turned toward the locking and actuating member with spacing from the axis to be measured crosswise to the force direction of the spring. As a result, the spring exerts on the cover flap present in closing position, via the locking and actuating member, a continuously acting torque, by which the cover flap is pressed permanently against the work support column. In this way, it is prevented that the cover flap can vibrate during operation of the sewing machine and cause noise.

In a sewing machine in which there is arranged in the area of the work support column a cutting device with a vertically extending knife shaft, a particularly advantageous structural design of the innovation is characterized in that the locking and actuating member and the spring designed as compression spring are arranged on the knife shaft.

Accordingly, it is an object of the invention to provide a cover construction for a sewing machine which includes a work support column below a sewing thread guide needle and which includes an upright support member with a substantially L-shaped cover member having a side forming portion pivotally supported on the support member and a cover plate portion and wherein the side forming portion has bearing faces defined on the back and bottom thereof respectively which are substantially at right angles to each other and further including a locking member displaceably positioned on the support member and having an upper, substantially horizontal bearing face adapted to bear against the side wall bearing face when the cover is in an open position and to bear against the bearing face on the bottom of the cover member when the cover member is closed and the bottom surface is oriented substantially horizontally and which further includes a first spring acting on the locking member to urge it against the cover to engage the bearing surface of the locking member with the respective bearing faces on the cover member and a second spring acting on the cover to rotate it to an open position.

A further object of the invention is to provide a cover construction particularly for sewing machines which is simple in design, rugged in construction and economical to manufacture.

For an understanding of the principles of the invention, reference is made to the following description of typical embodiments thereof as illustrated in the accompanying drawings.

IN THE DRAWINGS

GENERAL DESCRIPTION OF THE PREFERRED EMBODIMENTS

Figures 1, 2, 3:
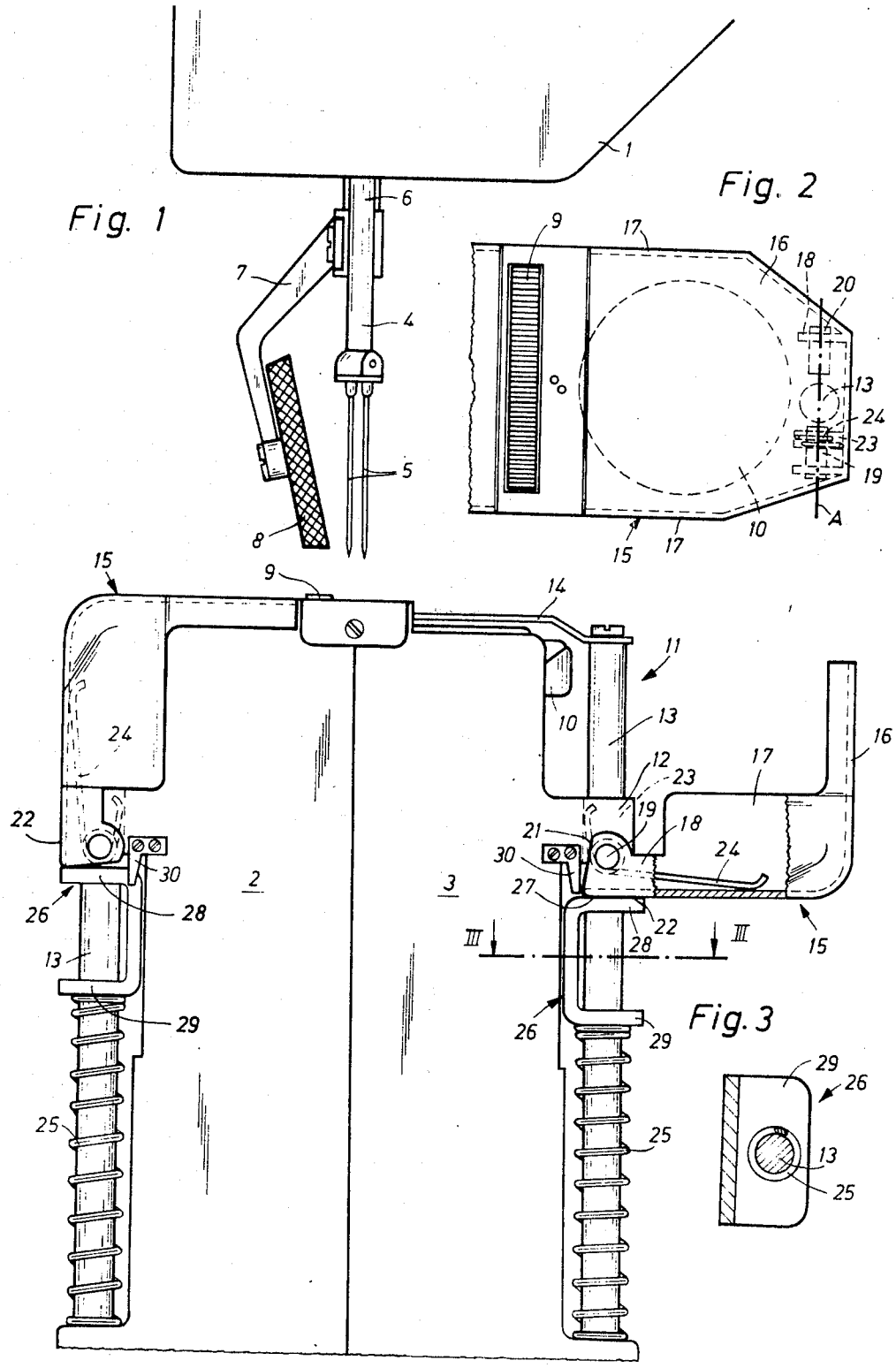
FIG. 1 is a partial elevational view of a sewing machine having two work-support columns arranged side-by-side and two cover constructions constructed in accordance with the invention.
FIG. 2 is a partial top plan view of the work-support column and single cover flap.
FIG. 3 is a partial sectional view of a locking member for the cover construction.

Referring to the drawings, in particular, the invention embodied therein comprises a cover construction for a sewing machine which includes a work-support column, in this case, two columns 2 and 3, which are disposed below the sewing thread guide needle or needles 5. In accordance with the invention, the upper construction includes an upright support member or knife shaft 13 and a substantially L-shaped cover member generally designated 15 which has a side-forming portion 17 pivotally supported on the support member 13 and a cover plate portion 16. A feature of the construction is that the side plate portion has bearing faces 21 and 22 defined on the back and bottom surfaces thereof, respectively, which are at substantially right angles to each other and engage on a top surface or bearing surface 27 of a U-shaped locking member which is mounted on the support member 13 for up and down movement.

In the sewing machine illustrated in FIG. 1, there are shown of the machine housing only the head 1 and two work support columns 2 and 3 arranged side by side.

In head 1 is mounted a needle bar 4 movable up and down in known manner, which carries two needles 5. A holder 7 is fastened on a presser bar 6 disposed in head 1 and the holder carries a roller foot 8.

In column 2, a driven slide wheel 9 is disposed for the transport of the work under the roller foot 8. Each column 2, 3 comprises a looper 10 driven in relation to the movement of the needle bar 4. Further each column 2 and 3 has associated with it a thread cutting device 11 which comprises a knife shaft 13 mounted in a lug 12 of each column 2, 3 and a thread catcher 14 provided with a knife (not shown).

For covering the looper 10, each column 2 and 3 has associated with it a cover flap 15. The two cover flaps 15 consists of an L-shaped cover plate 16, two side plates 17, and a substantially U-shaped projection 18 which surrounds lug 12. The cover flaps 15 are pivotable by means of two pins 19, 20, the horizontal axis being marked A. The U-shaped projection 18 of each cover flap 15 comprises two bearing faces 21, 22 parallel to axis A. In the closing position of flap 15, shown at column 2 in FIG. 1, the bearing face 22 extends exactly vertically, while the bearing face 21 extends under an acute angle to the horizontal. The two bearing faces 21, 22 are therefore substantially at right angles to each other. In a slot 23 of lug 12 there is arranged on pin 19 a spiral spring 24, whose one leg applies against the narrow limiting face of slot 23 and whose other leg applies against the inner side of cover flap 15.

Spiral spring 24 exerts on the cover flap 15 a torque which acts on the cover flap 15 in the direction of the open position in which the cover flap 15 of column 3 is in FIG. 1.

On each knife shaft 13 a compression spring 25 and a U-shaped locking and actuating member 26 is arranged. The upper face of the locking and actuating member 26, turned toward the respective cover flap 15, forms an abutment face 27 for the bearing faces 21 and 22. The legs 28 and 29 of each locking and actuating member 26 are made relatively wide, owing to which the lower leg 29 forms a handle for the operator.

In the closing position of the cover flaps 15, the compression spring 25 exerts, via the locking and actuating member 26, an upwardly directed force against the bearing face 21. As the bearing face 21 extends in this position under an acute angle to the horizontal and hence to the abutment face 27, the spring-loaded locking and actuating member 26 causes a continuously acting torque which is greater than the torque caused by the spiral spring 24. Consequently the cover flaps 15 are constantly pressed against the support column 2, 3.

To expose one of the loopers 10, the operator pushes with a finger on the lower leg 29 of the respective locking and actuating member 26 and displaces the latter from the locking position downward into a release position. Thereupon, the spiral spring 24 pivots the cover flap 15 into the open position against an abutment 30 on the support column 2, 3, which prevents the cover flap 15 from pivoting farther downward beyond the position shown in FIG. 1 with respect to column 3. After the locking and actuating member 26 has been let go, it is pushed upward again by the compression spring 25, owing to which its abutment face 27 applies against the bearing face 22 of cover flap 15 under spring pressure. In this way, the cover flap 15 is retained in the open position not only by the spiral spring 24 but additionally also by the compression spring 25 and the locking and actuating member 26.

While specific embodiments of the invention have been shown and described in detail to illustrate the application of the principles of the invention, it will be understood that the invention may be embodied otherwise without departing from such principles.

What is claimed is:

1. A cover construction for a sewing machine which includes a work support column below a sewing thread guide needle, comprising an upright support member, a substantially L-shaped cover member having a side-forming portion pivotally supported on said support member and a cover plate portion, said side-forming portion having bearing faces defined on the back and bottom thereof, respectively, which are at substantially right angles to each other, a locking member displaceably mounted on said support member and having an upper, substantially horizontal bearing face adapted to bear against said side wall bearing face when said cover is in an open position with said side wall portion oriented substantially horizontally and with said cover plate oriented substantially vertically and being adapted to also bear against said bottom bearing surface of said side wall portion when said cover is closed, first spring means urging said locking member against said cover, and second spring means urging said cover member to rotate to an open position, said locking member being movable against said first spring means to release said cover for automatically opening said cover by said second spring means.

2. A cover construction according to claim 1, wherein, when said cover is in a closed position, the bottom bearing face of said cover engages on said bearing face of said locking member and has a radial spacing from the axis of pivoting of said cover.

3. A cover construction according to claim 1, wherein said support member comprises an upright shaft, said first spring means comprising a coil spring around said shaft below said locking member, said locking member comprising a U-shaped handle.

4. A cover construction according to claim 1 wherein said U-shaped handle has a substantially horizontal portion at each end through which said shaft extends and an abutment mounted in a fixed position adjacent said upright support in a position to prevent said cover flap from pivoting further downward beyond an open position in which said bottom surface extends substantially vertically.

* * * * *